United States Patent [19]

Weber

[11] 4,331,729

[45] May 25, 1982

[54] HEAT RESISTANT AND PROTECTIVE FABRIC AND YARN FOR MAKING THE SAME

[75] Inventor: John W. Weber, Norristown, Pa.

[73] Assignee: Norfab Corporation, Norristown, Pa.

[21] Appl. No.: 211,816

[22] Filed: Dec. 1, 1980

[51] Int. Cl.[3] ..... B32B 7/00; D03D 15/00

[52] U.S. Cl. ..... 428/252; 57/224; 57/225; 57/244; 139/383 R; 139/420 R; 139/420 A; 428/263; 428/265

[58] Field of Search ..... 428/257, 263, 373, 377, 428/392, 394, 902, 920, 265, 272, 252; 57/210, 224, 225, 243, 244; 139/383 R, 420 R, 420 A

[56] References Cited

U.S. PATENT DOCUMENTS 2,179,087 11/1939 Gibbons .
2,230,271 2/1941 Simpson .
3,395,527 8/1968 Longley .
3,751,897 8/1973 Bailey .
3,811,262 5/1974 Clarkson .

*Primary Examiner*—Marion McCamish
*Attorney, Agent, or Firm*—Zachary T. Wobensmith, 2nd; Zachary T. Wobensmith, III

[57] ABSTRACT

A heat resistant fabric is provided, preferably woven, and with an optional aluminized backing, the fabric being made from yarns having a core of flame and high heat resistant non-melting heat stabilized polyacrylonitrile fibers covered by a layer of aramid fibers or other heat resisting fibers with or without blending with other fibers, the covering layer providing a cushion to provide increased abrasion resistance of the core while also providing a heat resistant covering for the core.

9 Claims, 2 Drawing Figures

FIG. 1
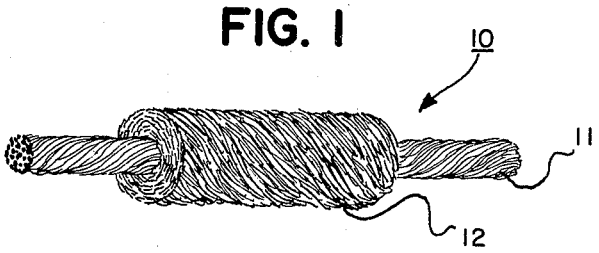
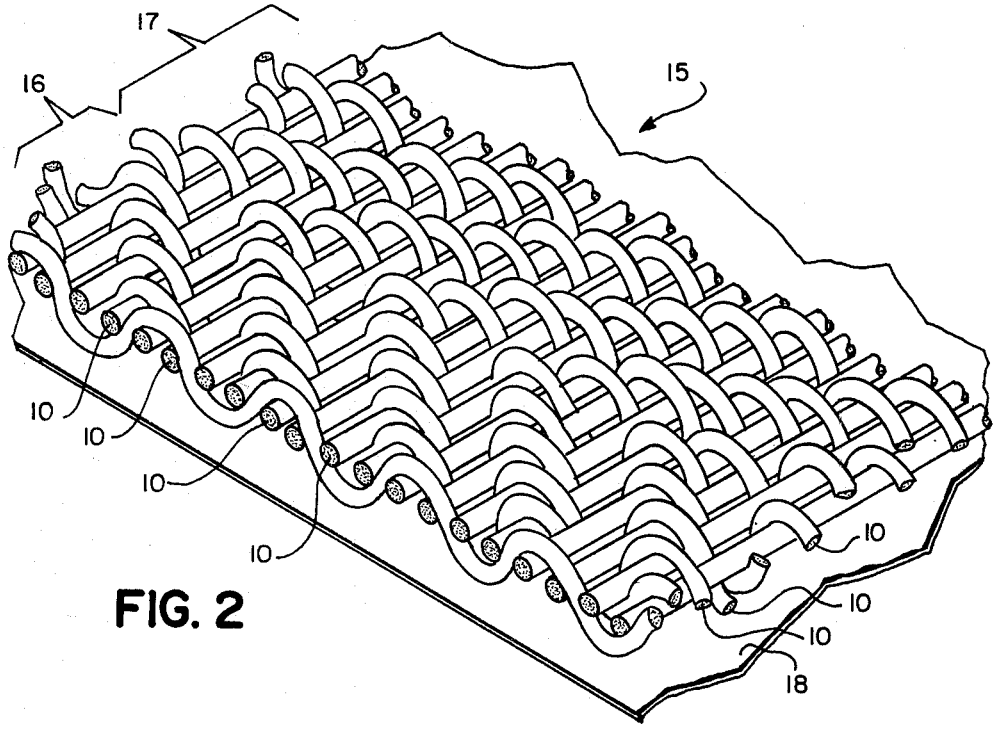
FIG. 2

HEAT RESISTANT AND PROTECTIVE FABRIC AND YARN FOR MAKING THE SAME

BACKGROUND OF THE INVENTION

1. Field of the Invention

This invention relates to heat resistant fabrics and yarn for making the same.

2. Brief Description of the Prior Art

It has heretofore been common practice to make heat resistant fabrics from yarns of asbestos fibers. Examples of asbestos yarns are shown in the U.S. Patents to Gibbons, No. 2,179,087; Simpson, No. 2,230,271; Longley, No. 3,395,527; Bailey, No. 3,751,897; and Clarkson, No. 3,811,262.

More recently the use of asbestos fibers for yarns and for other purposes has been considered hazardous to the user as well as other persons exposed to the fibers.

The fabric and yarn of the present invention do not employ asbestos nor other materials considered hazardous.

SUMMARY OF THE INVENTION

In accordance with the invention a fabric is provided suitable for protective garments and clothing, and for protection of equipment, which has high heat resistance, is resistant to thermal shock attendant upon splashing of molten metals, and which is made from yarns having high temperature resistance, with a central core of low abrasion resistant material wrapped with a covering also resistant to high temperature but being abrasion resistant and which protects the core, thereby providing a yarn suitable for use for protective fabrics. The core is preferably of heat stabilized polyacrylonitrile fibers and the wrapping is preferably of heat resisting fibers such as aramid fibers, polybenzimidazole fibers, or phenolic fibers, or a blend of any such fibers. A protective metallic lamination, adherent to the fabric, and which may be aluminum foil, may be employed to increase the heat reflectivity and effectiveness of the fabric.

It is the principal object of the invention to provide a fabric for protecting personnel and equipment, which fabric is resistant to high temperatures, to thermal shock, and abrasion, and which is light in weight and effective in use.

It is a further object of the invention to provide a yarn for making a protective fabric as aforesaid.

It is a further object of the invention to provide a composite yarn for the making of protective temperature and thermal shock resistant fabrics in which the core of the yarn is covered and protected so that the combined qualities of the core and the cover are made available.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which:

FIG. 1 is an enlarged view in elevation of the yarn in accordance with the invention, and FIG. 2 is an enlarged view in perspective of a suitable fabric made from the yarn of FIG. 1.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENTS

Referring now more particularly to FIG. 1 of the drawings a yarn 10 is there illustrated which includes a core 11 of fibers and a covering 12 of fibers enclosing the core 11.

The core 11 is preferably of flame and high heat resistant preoxidized carbon yarns and more specifically non-melting heat stabilized or carbonized polyacrylonitrile fibers, one suitable core material being available under the tradename Celiox, from Celanese Plastics and Specialties Company, Chatham, N.J., and another suitable core material being available under the tradename BAN-OX from Hitco Materials Division, Subsidiary of Armco Inc., Gardena, Calif.

The core 11 is of fragile material with low abrasion resistance, dependent upon the degree of stabilizing or carbonizing, and has a high temperature resistance and a thermal shock resistance to molten aluminum of the order of 1400° F. and to molten steel of the order of 2850° F.

The size and weight of the core 11 may be varied as desired, one suitable core being Tex #93. The core 11 may have a twist of the order of seven to nine turns per inch.

The cover 12 is preferably of aramid fibers, each fiber being individually wrapped around core 11, one suitable material being available under the tradename Kevlar from E. I. du Pont de Nemours & Company, Wilmington, Del. The covering 12 can also be of a blend of aramids, or of an aramid blended with other fibers. One suitable blend may consist of Kevlar, Nomex and Kynol of varying percentages of each. Nomex is the tradename of an aramid fiber available from E. I. du Pont de Nemours & Company. Kynol is the tradename of phenolic fibers available from Nippon Kynol Corporation of Japan, and available in the United States of America from American Kynol, Inc., of Altemonte Springs, Fla.

Other heat resisting fibers, such as polybenzimidazole, known as P.B.I. fibers, available from Celanese Corporation, of Chatham, N.J., or phenolic fibers, such as Kynol, may each be blended with other heat resisting fibers.

The size and weight of the covering 12 may be varied as desired. The covering 12 can be applied to the core 11 by wrapping the fibers around the core 11 so that it is completely covered.

The proportions of core to covering may be varied as desired.

The coverings 12, referred to above, are not as temperature resistant as the core 11 but provide a cushion around the core 11 so that its fragility and lack of abrasion resistance are largely overcome. A suitable yarn is thus provided capable of being fabricated into a textile fabric which is resistant to high temperatures and to thermal shock.

The enclosure of the core 11 within the covering 12 restricts the release of the fibers of the core 11 into the atmosphere, thereby reducing electrical hazards as well as minimizing inhalation of dust or dirt.

Referring now to FIG. 2 one suitable textile fabric 15 is there illustrated. The textile fabric 15 is shown as a herringbone weave with warp threads and filling threads both of the yarns 10 heretofore described. Warp threads and filling threads may be of single or plyed construction. The weave may be of any desired pattern to provide a stable textile fabric but as illustrated comprises unitary bands 16 and 17 of two up, two down twill and each of a width of approximately one half inch. The weight of the textile fabric may be varied as desired but fabrics weighing 16 oz., 18 oz. and 26 oz. per square yard, have been found suitable for a variety of purposes including protection of personnel and equipment. The textile fabric 15 can be made into protective clothing and maintenance fabrics. The textile fabric 15 has high heat and abrasion resistance, and resistance to thermal shock attendant upon splashing of molten metal.

As also shown in FIG. 2 a metallic lamination 18 can be provided, preferably of aluminum foil by vacuum application, by passing the fabric and the foil between pressure applying rolls after an adhesive has been applied to the fabric, or in any other desired manner, including spray coating, to increase heat reflectivity and further enhance the qualities of the fabric.

I claim:

1. A high temperature resistant woven textile fabric of yarn having a central core of high temperature resistant heat stabilized polyacrylonitrile fibers, said core being enclosed within a wrapping consisting of high temperature resistant fibers, and said wrapping consists of fibers selected from the group consisting of aramid fibers, polybenzimidazole fibers and phenolic fibers.

2. A textile fabric as defined in claim 1 in which said wrapping consists at least in part of aramid fibers.

3. A textile fabric as defined in claim 1 in which said woven textile fabric is a herringbone weave.

4. A textile fabric as defined in claim 1 in which said fabric has adherent to one face thereof a metallic lamination.

5. A textile fabric as defined in claim 4 in which said metallic lamination is aluminum foil.

6. A yarn resistant to high temperatures comprising a central core of high temperature resistant heat stabilized polyacrylonitrile fibers, said core being enclosed within a wrapping consisting at least in part of high temperature resistant fibers, and said wrapping is of fibers selected from the group consisting of aramid fibers, polybenzimidazole fibers and phenolic fibers.

7. A yarn as defined in claim 6 in which said wrapping consists at least in part of aramid fibers.

8. A yarn as defined in claim 6 in which said wrapping is of a blend of fibers including aramid fibers.

9. A yarn as defined in claim 6 in which said core fibers are subject to abrasion, and said wrapping cushions and protects the core fibers against abrasion.

* * * * *